US007162849B2

(12) United States Patent
Bernhard

(10) Patent No.: US 7,162,849 B2
(45) Date of Patent: Jan. 16, 2007

(54) BEVERAGE BOTTLING PLANT FOR FILLING BOTTLES WITH A LIQUID BEVERAGE MATERIAL HAVING A BOTTLE CLOSING DEVICE, AND A CLOSURE APPLYING MACHINE FOR CLOSING OF CONTAINERS, SUCH AS BOTTLES, CANS, CANISTERS, OR THE LIKE, BY WAY OF SCREWING ON OF SCREW CAPS

(75) Inventor: Herbert Bernhard, Wolfsheim (DE)

(73) Assignee: KHS Maschinen-UND Anlagenbau AG, Dortmund (DE)

( * ) Notice: Subject to any disclaimer, the term of this patent is extended or adjusted under 35 U.S.C. 154(b) by 0 days.

(21) Appl. No.: 10/982,706

(22) Filed: Nov. 5, 2004

(65) Prior Publication Data

US 2005/0126119 A1 Jun. 16, 2005

(30) Foreign Application Priority Data

Nov. 8, 2003 (DE) ..... 103 52 298

(51) Int. Cl.
*B65B 7/28* (2006.01)
*B65B 55/24* (2006.01)

(52) U.S. Cl. ..... 53/317; 53/167; 53/300; 53/331.5

(58) Field of Classification Search ..... 53/300, 53/306, 317, 331.5, 490, 167; 141/101, 129, 141/144

See application file for complete search history.

(56) References Cited

U.S. PATENT DOCUMENTS 2,076,631 A 4/1937 Gantzer
4,939,890 A * 7/1990 Peronek et al. ..... 53/300
5,713,403 A * 2/1998 Clusserath et al. ..... 141/129
5,816,029 A * 10/1998 Sweeny ..... 53/331.5
5,934,042 A * 8/1999 Peronek ..... 53/317
6,474,368 B1 * 11/2002 Clusserath et al. ..... 141/129
6,698,160 B1 * 3/2004 Peronek et al. ..... 53/317
6,834,478 B1 * 12/2004 Peronek et al. ..... 53/317
6,898,920 B1 * 5/2005 Hoss ..... 53/317

FOREIGN PATENT DOCUMENTS

EP 0 521 581 A1 1/1993

* cited by examiner

*Primary Examiner*—Louis Huynh
(74) *Attorney, Agent, or Firm*—Nils H. Ljungman & Associates

(57) ABSTRACT

A beverage bottling plant for filling bottles with a liquid beverage filling material, and a closure applying machine for closing of containers, such as, for example, bottles, cans, canisters, or the like, by way of screw caps that are screwed on, with a plurality of closure applying positions that are provided at the circumference of a rotatable machine rotor that rotates about a vertical machine axis, to which positions the containers to be closed are transferred at a container input and the closed containers are removed therefrom at a container output, whereby each closure applying position is having a container carrier, a container support and a screw unit, said screw unit having at its lowermost end a screw head and that can rotate about a vertically directed axis and being configured to be rotated by a drive and wherein the screw head during rotation of the rotor remains at a height level, with provision being made that the container support comprises means that assuredly effectuate an assured separation of the screw closure and screw head.

17 Claims, 3 Drawing Sheets

BEVERAGE BOTTLING PLANT FOR FILLING BOTTLES WITH A LIQUID BEVERAGE MATERIAL HAVING A BOTTLE CLOSING DEVICE, AND A CLOSURE APPLYING MACHINE FOR CLOSING OF CONTAINERS, SUCH AS BOTTLES, CANS, CANISTERS, OR THE LIKE, BY WAY OF SCREWING ON OF SCREW CAPS

BACKGROUND

1. Technical Field

The present application relates to a beverage bottling plant for filling bottles with a liquid beverage filling material having a bottle closing device, and a closure applying machine described herein below.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine. Upon filling, a closing station closes the filled bottles. There may further be provided a conveyer arrangement configured to transfer filled bottles from the filling machine to the closing station. Bottles may be labeled in a labeling station, the labeling station having a conveyer arrangement to receive bottles and to output bottles. The closing station and the labeling station may be connected by a corresponding conveyer arrangement.

Closure applying machines for closing of containers, such as, for example, bottles, cans, canisters, or the like, by way of positioning caps at the top for capping, or by way of screwing of screw caps at the top for capping, said caps being made of metal or plastic, either with or without a screw threading that is part of the cap, are essentially known, such as, from U.S. Pat. No. 2,076,631 or from European Patent No. 0 521 581.

In such closure applying machines, a plurality of closure applying positions are provided in evenly-distributed manner at the circumference of a rotatable machine rotor, to which positions the containers to be closed are transferred at a container input and the closed containers are removed therefrom at a container output.

Each closure applying position has a container support and a screw spindle that has at a lowermost end a screw head and that can rotate about a container axis or, respectively, can rotate about a spindle axis, with the screw spindle comprising a drive configured to rotate the screw spindle, with the drive of the screw spindle being configured to be adjustable or, respectively, being configured to be controllable with respect to the torque that is to be transferred to the screw heads and/or being configured to be controllable with respect to the number of revolutions of the screw heads.

In known arrangements, the screw caps are respectively moved by a carrier that is arranged at each closure applying element, and the screw caps are moved in upward direction along an inclined plane. While being moved in the upward direction, the screw caps are urged into the screw heads, are precisely positioned above the screw caps, and in the precisely aligned position they are clamped to the screw head. This procedure provides that the screw caps are ready for application in the subsequent closing operation.

In the following only those closure applying machines are dealt with in which the screw-units remain at the same height-level during one rotation.

In such closure applying machines, the containers to be closed are lifted and, accordingly, they are urged against the screw heads that are spring-biased or, respectively, they are urged against the screw caps that are disposed in the screw heads, and these screw caps are screwed onto the container mouths by the rotatable screw heads. Subsequently, the now closed containers are lowered again and removed from the closure applying machine.

The present application is particularly concerned with closing of containers, such as, bottles, cans, or canisters that are configured with a screw threading that is providing a finished screw threading.

In such closure applying machines, but also in other machines that are comparable in terms of operation, there arises a repeated clamping action such that individual screw caps are attached to the screw heads to such an extent that this connection is not severed upon closing of the container and upon lowering of the container support.

As a consequence, the screw cap and the container that is closed by the screw cap together can not leave the closure applying machine, but instead can cause soiling, production disruptions, or even serious damage to the closure applying machine during the next rotation.

Based on the knowledge of the applicant of the prior art, no proposals for the solutions of this problem have been advanced for closure applying machines in which the screw-units remain at one height-level during one rotation.

An example of a possible embodiment of a closure applying machine for putting caps on bottles may be found in U.S. patent application Ser. No. 10/982,694, and entitled "A beverage bottling plant for filling bottles with a liquid beverage filling material having a closing machine for closing containers," which application was filed on Nov. 5, 2004. The above U.S. patent application is hereby incorporated by reference as if set forth in its entirety herein.

OBJECT OR OBJECTS

It is the aim and object of the present application to introduce an arrangement that substantially minimizes the aforementioned disadvantages. For this, the present application provides that the container carrier is equipped with a particularly advantageously designed container support, which container support comprises means that achieve a positive separation of the screw cap from the screw head.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

In the following, the embodiments are further described in detail with reference to embodiment examples.

DESCRIPTION OF EMBODIMENT OR EMBODIMENTS

Figure 1:
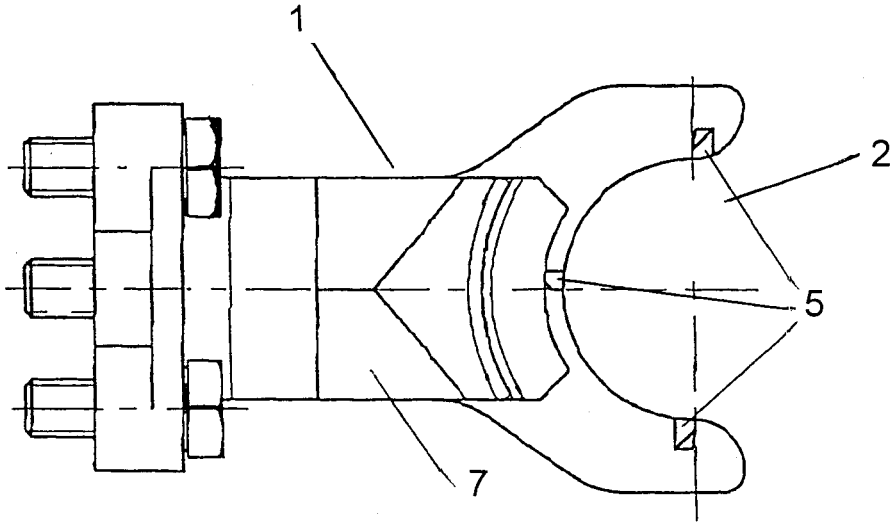
FIG. 1 the top plan view of a container support 1 in accordance with a possible embodiment.

Further development details, advantages and possibilities of application of the application can be obtained from the following description of embodiments and the drawing. With this, all described and/or illustrated features per se or in any combination, comprise the substance of the application, regardless of their combination in the claims or their dependency. At the same time, the content of the claims is made a component of the description.

Figure 1A:
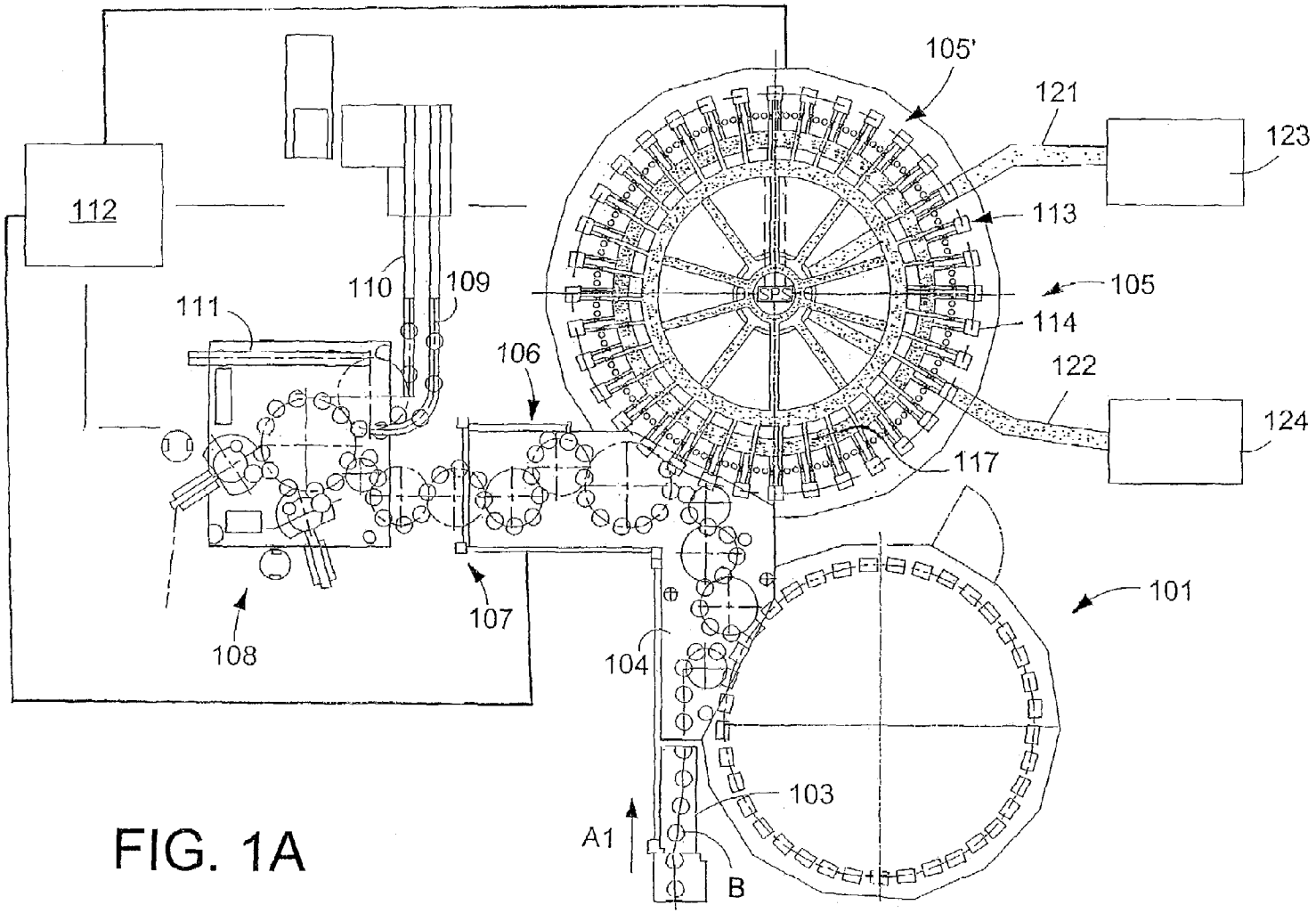
FIG. 1A is a schematic illustration of a container filling plant in accordance with one possible embodiment.
Figure 3:
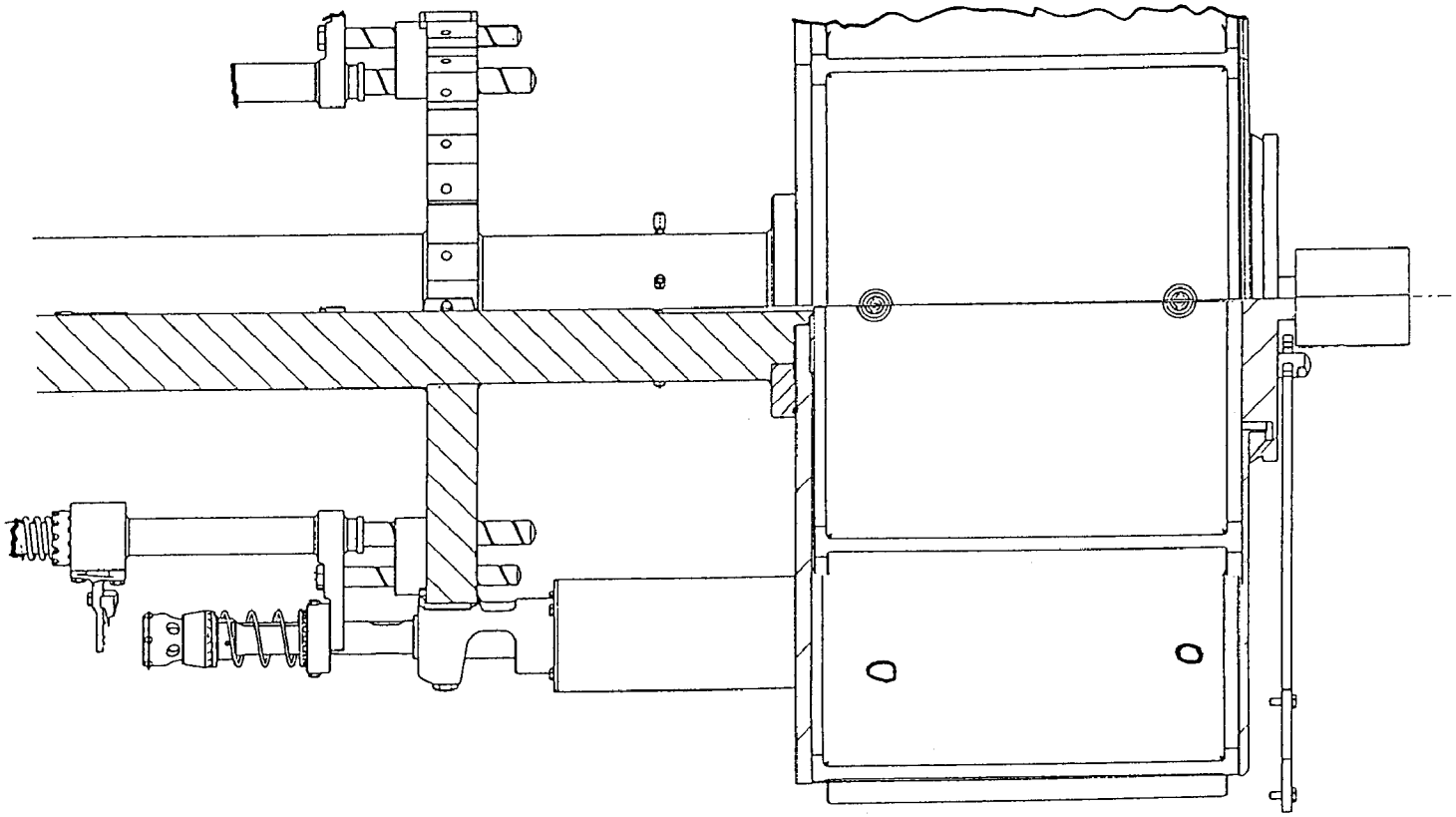
FIG. 3 in a much simplified and partially in a cross-section illustration a full elevational view of a closure applying machine.

FIG. 1A shows a rinsing arrangement or rinsing station 101, to which the containers, namely bottles B, are fed in the direction of travel as is indicated by the arrow A1, by means of a conveyer line or conveyer arrangement to feed bottles to rinsing arrangement 103, and downstream of rinsing arrangement or rinsing station 101, in the direction of travel as is indicated by the arrow A1, the rinsed bottles B are transported to a beverage filling machine 105 by means of a conveyer line or conveyer arrangement 104 to pass bottles to filling machine that is formed, for example, by a starwheel conveyer or a plurality of starwheels of a conveyer arrangement. The conveyer arrangement 104 to pass bottles to filling machine may possibly comprise a starwheel conveying structure that introduces bottles B to the filling machine 105.

Downstream of the filling machine 105, in the direction of travel of the bottles B, there can preferably be a closing arrangement or closing station 106 which closes the bottles B.

The closing arrangement or closing station 106 can, for example, be connected directly to a labeling arrangement or labeling station 108 having at least one labeling unit, device, or module for first product, each unit having a head, such as, for example, by means of a conveyer arrangement 107 to pass bottles to labeling arrangement that may be formed, for example, by a plurality of starwheels of a conveyer arrangement.

In the illustrated embodiment, the labeling arrangement or labeling station 108 having at least one labeling unit, device, or module for first product, each unit having a head has, for example, three outputs, namely one output formed by a conveyer arrangement 109 to convey first product bottles for bottles B that are filled with a first product. The first product may possibly be provided by a first product mixer 123 that is connected to the filling machine 105, for example, through a conduit for first product 121, and bottles B that are filled with a predetermined volume of liquid beverage filling material, that is, the first product, are then labeled by a labeling module in the labeling arrangement or labeling station 108 having at least one labeling unit, device, or module for first product, each unit having a head, corresponding to this first product delivered from first product mixer 123 to the beverage filling machine 105 and thence to the corresponding bottles B.

A second output that is formed by a conveyer arrangement 110 to convey second product bottles is provided for those bottles B that are filled with a second product. The second product may emanate from a second product mixer 124 that is connected, for example, through a conduit for second product 122 to the filling machine 105, and these bottles B filled with a predetermined volume of liquid beverage filling material comprising the second product are then correspondingly labeled by a labeling module in the labeling arrangement or labeling station 108 having at least one labeling unit, device, or module for first product, each unit having a head, corresponding to this second product.

A third output, for example, formed by a conveyer arrangement 111 to convey incorrectly labeled bottles, removes any bottles B which have been incorrectly labeled as may have been determined by an inspecting device or an inspecting station, or an inspecting module 128 that may possibly form a part of the labeling arrangement or labeling station 108 having at least one labeling unit, device, or module for first product, each unit having a head.

In FIG. 1A item 112 is a central control arrangement or, expressed differently, a controller with a computer to process algorithms, which controls the operation of the above-referenced system or plant.

The beverage filling machine 105 is preferably of the revolving design, with a rotor 105', which revolves around a vertical machine axis. The rotor 105' is designed to handle the bottles B by the neck. A filling arrangement 114 having at least one filling device, element, apparatus, or valve, comprises an apparatus configured to introduce a predetermined volume of liquid beverage filling material into the interior of bottles B to a predetermined level of liquid beverage filling material. Furthermore, the filling device or apparatus comprises an apparatus configured to terminate the filling of bottles upon liquid beverage filling material reaching the predetermined level in bottles B. In other words, the filling arrangements 114 having at least one filling device, element, apparatus, or valve, are configured and disposed to provide a predetermined flow of liquid beverage filling material from the source thereof, such as, product mixers 123 and 124, into the bottles B.

The toroidal vessel 117 is a component, for example, of the revolving rotor 105'. The toroidal vessel 117 can be connected by means of a rotary coupling or a coupling that permits rotation, and by means of the conduit for first product 121 to the external reservoir or first product mixer 123 to supply the product.

As well as the more typical filling machines having one toroidal vessel, it is possible that in at least one possible embodiment a filling machine could possibly be utilized wherein each filling arrangement 114 having at least one filling device, element, apparatus, or valve is preferably connected by means of two, connections to a toroidal vessel 117 which contains a first product, say by means of a first connection, for example, the conduit for first product 121, and to a second toroidal vessel which contains a second product, say by means of the second connection, for example, the conduit for second product 122. In this case, each filling arrangement 114 having at least one filling device, element, apparatus, or valve can also preferably have, at the connections, two individually-controllable fluid or control valves, so that in each bottle B which is delivered at the inlet of the filling machine 105 to a filling position 113, the first product or the second product can be filled by means of an appropriate control of the filling product or fluid valves.

It will be understood that while a two-product assembly or system of a bottling plant is illustrated in FIG. 1A, the disclosure is equally applicable to single-product installations, or other commensurate embodiments.

As is illustrated in FIG. 1, the container support 1 has, firstly, a recess 2, with the geometrical configuration of said recess being essentially adapted to the contour and/or the diameter of the container neck that is to be received by said recess.

By way of a controlled downwardly directed movement of the container support 1, the container 3 and the screw closure 4 that is screwed thereon are to be assuredly removed by a pulling force from the screw head, said screw head not being illustrated, such that the container 3 can be placed on a corresponding support arrangement of the closure applying machine during the further course of the downwardly direct movement, and subsequently the container can be separated from the container support arrangement.

In order to carry out this function in an assured manner, the present application provides that the bottom side of the container support 1 is adapted to the structural configuration of the container 3. When proceeding in this manner, it is particularly advantageous that damage of the container, that may arise, particularly in the case of containers made of plastic, when the containers 3 are to be removed with great force from the screw heads.

Figure 2:
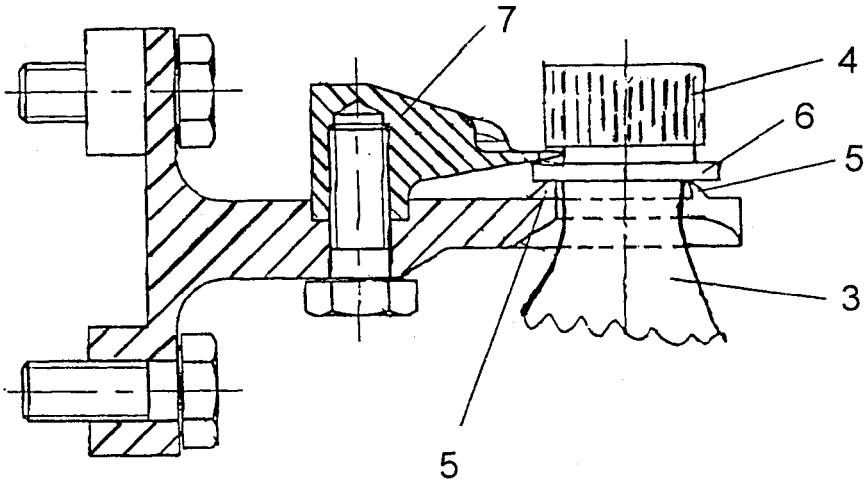
FIG. 2 in a side elevation, shown in cross-section, also the container support 1, this container support being in operative connection with a container.

In a further embodiment, that is particularly suitable for the processing of containers 3 that comprise a necking 6, there is provided that the container support 1 comprises an additional depressor 7. As is shown in FIG. 2, this depressor 7 effectively engages with the neck ring in an operative connection and substantially completely prevents, upon removal of the screw closure or screw cap 4 from the screw head, a possible vertically directed movement of the container 3, this leading to an assured separation or removal. Furthermore, when proceeding in this manner, the outer contour of the container 3 is assuredly protected against damage.

In a further embodiment, there is provided that the container support 1 is equipped with at least one stop element 5, said stop element 5 preventing the turning of the container 3 with the attendant arrangement during the closing steps.

This at least one stop element 5 can comprise, for example, a spring element that exerts a clamping force upon the container 3. Equally, for one or several stop elements 5 may comprise elements that effectuate an increased frictional force between the container 3 and the container support 1. As examples may be mentioned, for example, elements of rubber and/or plastic, elements with a corresponding surface with corresponding coatings and specially roughened surfaces.

Such elements, however, may also comprise, as is shown in the embodiment example, elements that oppose, due to a biasing force and/or the geometrical configuration, a turning of the container 3. In order to illustrate the functioning of these elements, at this point, for example, spring rings or resilient toothed rings may be mentioned, such elements being known, inter alia, in the technique of securing screws.

The scope of the present application comprises embodiments in which one or more stop elements 5 directly act upon the container neck as well as embodiments wherein the elements act upon a possibly present neck ring 6 of the container.

One feature or aspect of an embodiment is believed at the time of the filing of this patent application to possibly reside broadly in a closure applying machine for closing of containers, such as, for example, bottles, cans, canisters, or the like, by way of screw caps that are screwed on, with a plurality of closure applying positions that are provided at the circumference of a rotatable machine rotor that rotates about a vertical machine axis, to which positions the containers to be closed are transferred at a container input and the closed containers are removed therefrom at a container output, with each closure applying position having a container carrier, a container support, and a screw unit, said screw unit having at its lowermost end a screw head and that can rotate about a vertically directed axis and being configured to be rotated by a drive and wherein the screw head during rotation of the rotor remains at a height-level, characterized in that the container support comprises means that effectuate an assured separation of screw closure and screw head.

Another feature or aspect of an embodiment is believed at the time of the filing of this patent application to possibly reside broadly in a closure applying machine, characterized in that the means comprise at least one depressor.

Yet another feature or aspect of an embodiment is believed at the time of the filing of this patent application to possibly reside broadly in a closure applying machine, characterized in that the means comprise a container support said container support comprising a lower contour that is adapted to the structural configuration of the container.

Still another feature or aspect of an embodiment is believed at the time of the filing of this patent application to possibly reside broadly in a closure applying machine, characterized in that the container support comprises means that are configured to oppose rotation of the container.

A further feature or aspect of an embodiment is believed at the time of the filing of this patent application to possibly reside broadly in a closure applying machine, characterized in that these means comprise spring elements.

Another feature or aspect of an embodiment is believed at the time of the filing of this patent application to possibly reside broadly in a closure applying machine, characterized in that these means comprise means that are configured to apply an elevated frictional force.

Yet another feature or aspect of an embodiment is believed at the time of the filing of this patent application to possibly reside broadly in a closure applying machine, characterized in that these means comprise means that oppose a rotation of the container due to their structural configuration and/or a spring bias action.

One feature or aspect of an embodiment is believed at the time of the filing of this patent application to possibly reside broadly in a beverage bottling plant for filling bottles with a liquid beverage material, said beverage bottling plant comprising: a bottle cleaning machine being configured and disposed to clean empty bottles; a feed arrangement to supply empty bottles to said bottle cleaning machine; a beverage filling machine being configured and disposed to fill empty bottles with liquid beverage filling material; said beverage filling machine comprising a plurality of beverage filling devices for filling bottles with liquid beverage filling material; a first conveyer arrangement being configured and disposed to move empty bottles from said bottle cleaning machine into said beverage filling machine; said first conveyer arrangement comprising a star wheel structure; a rotatable bottle closing machine being configured and disposed to close tops of filled bottles by screwing on screw caps or closures; a second conveyer arrangement being configured and disposed to move filled bottles from said rotatable beverage filling machine into said bottle closing machine; said second conveyer arrangement comprising a star wheel structure; and said bottle closing machine comprising a plurality of closing devices disposed on the periphery of said bottle closing machine; each of said plurality of closing devices comprising: a bottle support being configured and disposed to receive and hold filled bottles; a rotatable screw shaft being configured and disposed to be rotated to screw a screw cap or closure on a filled bottle; said screw shaft comprises a screw head disposed on an end of said screw shaft; said screw head being configured and disposed to pick up and hold a screw cap or closure to be screwed onto a filled bottle; said screw head being configured to remain at a predetermined height during rotation thereof; a drive motor being configured and disposed to rotate said screw shaft; and said bottle support being configured to effectuate a complete separation of said screw cap or closure and said screw head upon said screw cap or closure being screwed onto a filled bottle.

Yet another feature or aspect of an embodiment is believed at the time of the filing of this patent application to possibly reside broadly in a beverage bottling plant, wherein said bottle support comprises at least one depressor structure.

Still another feature or aspect of an embodiment is believed at the time of the filing of this patent application to possibly reside broadly in a beverage bottling plant, wherein said bottle support comprises a lower contour that is adapted to the structural configuration of a bottle.

A further feature or aspect of an embodiment is believed at the time of the filing of this patent application to possibly reside broadly in a beverage bottling plant, wherein said bottle support comprises a structural arrangement to oppose rotation of a bottle being held by said bottle support upon screwing on of said screw cap or closure.

Another feature or aspect of an embodiment is believed at the time of the filing of this patent application to possibly reside broadly in a beverage bottling plant, wherein said structural arrangement comprises spring elements.

Yet another feature or aspect of an embodiment is believed at the time of the filing of this patent application to possibly reside broadly in a beverage bottling plant, wherein said structural arrangement comprises is configured to apply an elevated frictional force on a bottle.

Still another feature or aspect of an embodiment is believed at the time of the filing of this patent application to possibly reside broadly in a beverage bottling plant, wherein said structural arrangement is configured to oppose rotation of a bottle due to structural configuration and/or a spring bias action of said structural arrangement.

One feature or aspect of an embodiment is believed at the time of the filing of this patent application to possibly reside broadly in a rotatable bottle closing machine being configured and disposed to close tops of filled bottles by screwing on screw caps or closures, said bottle closing machine comprising: at least one bottle closing device comprising: a bottle support being configured and disposed to receive and hold filled bottles; a rotatable screw shaft being configured and disposed to be rotated to screw a screw cap or closure on a filled bottle; said screw shaft comprises a screw head disposed on an end of said screw shaft; said screw head being configured and disposed to pick up and hold a screw cap or closure to be screwed onto a filled bottle; said screw head being configured to remain at a predetermined height during rotation thereof; a drive motor being configured and disposed to rotate said screw shaft; and said bottle support being configured to effectuate a complete separation of said screw cap or closure and said screw head upon said screw cap or closure being screwed onto a filled bottle.

Another feature or aspect of an embodiment is believed at the time of the filing of this patent application to possibly reside broadly in a rotatable bottle closing machine, wherein said bottle support comprises at least one depressor structure.

Yet another feature or aspect of an embodiment is believed at the time of the filing of this patent application to possibly reside broadly in a rotatable bottle closing machine, wherein: said bottle support comprises a lower contour that is adapted to the structural configuration of a bottle; and said bottle support comprises a structural arrangement to oppose rotation of a bottle being held by said bottle support upon screwing on of said screw cap or closure.

Still another feature or aspect of an embodiment is believed at the time of the filing of this patent application to possibly reside broadly in a rotatable bottle closing machine, wherein said structural arrangement comprises spring elements.

A further feature or aspect of an embodiment is believed at the time of the filing of this patent application to possibly reside broadly in a rotatable bottle closing machine, wherein said structural arrangement comprises is configured to apply an elevated frictional force on a bottle.

Yet another feature or aspect of an embodiment is believed at the time of the filing of this patent application to possibly reside broadly in a rotatable bottle closing machine, wherein said structural arrangement is configured to oppose rotation of a bottle due to structural configuration and/or a spring bias action of said structural arrangement.

The components disclosed in the various publications, disclosed or incorporated by reference herein, may possibly be used in possible embodiments, as well as equivalents thereof.

The appended drawings in their entirety, including all dimensions, proportions and/or shapes in at least one embodiment, are accurate and are hereby included by reference into this specification.

Some examples of bottling systems that may possibly be utilized or possibly adapted for use in at least one possible embodiment of the present application may possibly be found in the following U.S. patents, all assigned to the Assignee herein, namely: U.S. Pat. No. 4,911,285; U.S. Pat. No. 4,944,830; U.S. Pat. No. 4,950,350; U.S. Pat. No. 4,976,803; U.S. Pat. No. 4,981,547; U.S. Pat. No. 5,004,518; U.S. Pat. No. 5,017,261; U.S. Pat. No. 5,062,917; U.S. Pat. No. 5,062,918; U.S. Pat. No. 5,075,123; U.S. Pat. No. 5,078,826; U.S. Pat. No. 5,087,317; U.S. Pat. No. 5,110,402; U.S. Pat. No. 5,1 29,984; U.S. Pat. No. 5,1 67,755; U.S. Pat. No. 5,174,851; U.S. Pat. No. 5,185,053; U.S. Pat. No. 5,217,538; U.S. Pat. No. 5,227,005; U.S. Pat. No. 5,413,153; U.S. Pat. No. 5,558,138; U.S. Pat. No. 5,634,500; U.S. Pat. No. 5,713,403; U.S. Pat. No. 6,276,113; U.S. Pat. No. 6,213,169; U.S. Pat. No. 6,189,578; U.S. Pat. No. 6,192,946; U.S. Pat. No. 6,374,575; U.S. Pat. No. 6,365,054; U.S. Pat. No. 6,619,016; U.S. Pat. No. 6,474,368; U.S. Pat. No. 6,494,238; U.S. Pat. No. 6,470,922; and U.S. Pat. No. 6,463,964.

All, or substantially all, of the components and methods of the various embodiments may be used with at least one embodiment or all of the embodiments, if more than one embodiment is described herein.

The corresponding foreign and international patent publication applications, namely, Federal Republic of Germany Patent Application No. 103 52 298.0, filed on Nov. 8, 2003, having inventor Herbert BERNHARD, and DE-OS 103 52 298.0 and DE-PS 103 52 298.0, as well as their published equivalents, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

Some examples of stepping motors that may possibly be utilized or possibly adapted for use in at least one possible embodiment of the present application may possibly be found in the following U.S. patents: U.S. Pat. No. 6,348,774 issued to Andersen et al. on Feb. 19, 2002; U.S. patents: U.S. Pat. No. 6,373,209 issued to Gerber et al. on Apr. 16, 2002; U.S. patents: U.S. Pat. No. 6,424,061 issued to Fukuda et al. on Jul. 23, 2002; U.S. patents: U.S. Pat. No. 6,509,663 issued to Aoun on Jan. 21, 2003; U.S. patents: U.S. Pat. No. 6,548,923 to Ohnishi et al. on Apr. 15, 2003; and U.S. patents: U.S. Pat. No. 6,661,193 issued to Tsai on Dec. 9, 2003.

All of the patents, patent applications and publications recited herein, and in the Declaration attached hereto, are hereby incorporated by reference as if set forth in their entirety herein.

Some examples of bottle closing machines which may possibly be utilized or adapted for use in at least one possible embodiment may possibly be found in the following U.S. Patents: U.S. Pat. No. 4,389,833, entitled "Bottle closing machine having bottle neck washing arrangement;" U.S. Pat. No. 4,205,502, entitled "Rotary bottle closing machine;" U.S. Pat. No. 6,484,477, entitled "Capping machine for capping and closing containers, and a method for closing containers;" U.S. Pat. No. 6,430,896, entitled "Capping machine;" U.S. Pat. No. 5,918,442, entitled "In-line capping machine;" U.S. Pat. No. 5,400,564, entitled "Capping machine;" and U.S. Pat. No. 5,669,209, entitled "In-line capping machine."

Some examples of sensors that may possibly be utilized or possibly adapted for use in at least one possible embodiment of the present application may possibly be found in the following U.S. Patents: U.S. Pat. No. 6,062,248 issued to Boelkins on May 16, 2000; U.S. Pat. No. 6,223,593 issued to Kubisiak et al. on May 1, 2001; U.S. Pat. No. 6,466,035 issued to Nyfors et al. on Oct. 15, 2002; U.S. Pat. No. 6,584,851 issued to Yamagishi et al. on Jul. 1, 2003; U.S. Pat. No. 6,631,638 issued to James et al. on Oct. 14, 2003; and U.S. Pat. No. 6,707,307 issued to McFarlane et al. on Mar. 16, 2004.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of servo-motors that may possibly be utilized or possibly adapted for use in at least one possible embodiment of the present application may possibly be found in the following U.S. patents: U.S. Pat. No. 4,050,434 issued to Zbikowski et al. on Sep. 27, 1977; U.S. Pat. No. 4,365,538 issued to Andoh on Dec. 28, 1982; U.S. Pat. No. 4,550,626 issued to Brouter on Nov. 5, 1985; U.S. Pat. No. 4,760,699 issued to Jacobsen et al. on Aug. 2, 1988; U.S. Pat. No. 5,076,568 issued to de Jong et al. on Dec. 31, 1991; and U.S. Pat. No. 6,025,684 issued to Yasui on Feb. 15, 2000.

In the event that automatic tool changes would be desirable in a possible embodiment, some examples of automatic tool changer apparatuses which may possibly be utilized or adapted for use in at least one possible embodiment may possibly be found in the following U.S. patents: U.S. Pat. No. 5,300,006, entitled "Automatic tool changer;" U.S. Pat. No. 4,835,838, entitled "Automatic tool changer in machine tool;" U.S. Pat. No. 4,799,308, entitled "Automatic tool changer;" U.S. Pat. No. 4,773,152, entitled "Automatic tool changer;" U.S. Pat. No. 4,764,064, entitled "Tool changer;" U.S. Pat. No. 4,696,091, entitled "Automatic tool changer;" U.S. Pat. No. 4,614,137, entitled "Magnetic tool changer;" U.S. Pat. No. 4,610,074, entitled "Automatic tool changer of a machine tool;" U.S. Pat. No. 4,601 ,094, entitled "Turning machine with an automatic tool changer;" U.S. Pat. No. 4,499,650, entitled "Automatic tool changer;" U.S. Pat. No. 4,467,517, entitled "Tool changer for facing head;" U.S. Pat. No. 4,387,502, entitled "Semi-automatic tool changer;" and U.S. Pat. No. 4,329,770, entitled "Automatic tool changer."

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

Some examples of bottling systems which may possibly be utilized or adapted for use in at least one possible embodiment may possibly be found in the following U.S. patents: U.S. Pat. No. 6,684,602, entitled "Compact bottling machine;" U.S. patents: U.S. Pat. No. 6,470,922, entitled "Bottling plant for bottling carbonated beverages;" U.S. patents: No. 6,390,150, entitled "Drive for bottling machine;" U.S. patents: U.S. Pat. No. 6,374,575, entitled "Bottling plant and method of operating a bottling plant;" U.S. patents: U.S. Pat. No. 6,192,946, entitled "Bottling system;" U.S. patents: U.S. Pat. No. 6,185,910, entitled "Method and an apparatus for high-purity bottling of beverages;" U.S. patents: U.S. Pat. No. 6,058,985, entitled "Bottling machine with a set-up table and a set-up table for a bottling machine and a set-up table for a bottle handling machine;" U.S. patents: U.S. Pat. No. 5,996,322, entitled "In-line bottling plant;" U.S. patents: U.S. Pat. No. 5,896,899, entitled "Method and an apparatus for sterile bottling of beverages;" U.S. patents: U.S. Pat. No. 5,848,515, entitled "Continuous-cycle sterile bottling plant;" U.S. patents: U.S. Pat. No. 5,634,500, entitled "Method for bottling a liquid in bottles or similar containers;" and U.S. patents: U.S. Pat. No. 5,425,402, entitled "Bottling system with mass filling and capping arrays."

Some examples of labeling machines which may possibly be utilized in at least one possible embodiment may possibly be found in the following U.S. patents: U.S. Pat. No. 6,634,400, entitled "Labeling machine;" U.S. Pat. No. 6,561,246, entitled "Labeling machine capable of precise attachment of a label to different sizes of containers;" U.S. patents: U.S. Pat. No. 6,550,512, entitled "Labeling machine capable of preventing erroneous attachment of labels on containers;" U.S. patents: No. 6,543,514, entitled "In-line continuous feed sleeve labeling machine and method;" U.S. patents: U.S. Pat. No. 6,378,587, entitled "Cylindrical container labeling machine;" U.S. patents: U.S. Pat. No. 6,328,086, entitled "Labeling machine;" U.S. patents: U.S. Pat. No. 6,315,021, entitled "Labeling machine;" U.S. patents: No. 6,263,940, entitled "In-line continuous feed sleeve labeling machine and method;" U.S. patents: U.S. Pat. No. 6,199,614, entitled "High speed labeling machine having a constant tension driving system;" U.S. patents: No. 6,167,935, entitled "Labeling machine; U.S. patents: U.S. Pat. No. 6,066,223, entitled "Labeling machine and method; U.S. patents: U.S. Pat. No. 6,050,319, entitled "Non-round container labeling machine and method;" and U.S. patents: No. 6,045,616, entitled "Adhesive station and labeling machine."

The details in the patents, patent applications and publications may be considered to be incorporable, at applicant's option, into the claims during prosecution as further limitations in the claims to patentably distinguish any amended claims from any applied prior art.

Some examples of starwheels which may possibly be utilized or adapted for use in at least one possible embodiment may possibly be found in the following U.S. patents: U.S. Pat. No. 5,613,593, entitled "Container handling starwheel;" U.S. Pat. No. 5,029,695, entitled "Improved starwheel;" U.S. Pat. No. 4,124,112, entitled "Odd-shaped container indexing starwheel;" and U.S. Pat. No. 4,084,686, entitled "Starwheel control in a system for conveying containers."

Some examples of beverage bottling systems which may possibly be utilized or adapted for use in at least one possible embodiment may possibly be found in the following U.S. Patents, and are hereby incorporated by reference as if set forth in their entirety herein: U.S. patents: U.S. Pat. No. 6,494,238, entitled "Plant for filling beverage into beverage bottles and other beverage containers having apparatus for replacing remaining air volume in filled beverage bottles or other beverage containers;" U.S. patents: No. 6,474,368, entitled "Beverage container filling machine, and method for filling containers with a liquid filling material in a beverage container filling machine;" U.S. patents: U.S. Pat. No. 6,470,922, entitled "Bottling plant for bottling carbonated beverages;" U.S. patents: No. 6,463,964, entitled "Method of operating a machine for filling bottles, cans or the like beverage containers with a beverage, and a beverage container filling machine;" U.S. patents: U.S. Pat. No. 6,374,575, entitled "Bottling plant and method of operating a bottling plant;" U.S. patents: U.S. Pat. No. 6,365,054, entitled "Plant for filling containers and a method for operating a plant for filling containers," U.S. patents: No. 6,192,946, entitled "Bottling system;" U.S. patents: U.S. Pat. No. 6,189,578, entitled "Filling system and filling element;" U.S. patents: U.S. Pat. No. 6,058,985, entitled "Bottling machine with a set-up table and a set-up table for a bottling machine and a set-up table for a bottle handling machine;" U.S. patents: U.S. Pat. No. 5,713,403, entitled "Method and system for filling containers with a liquid filling product, and filling machine and labelling device for use with this method or system," U.S. patents: No. 5,634,500, entitled "Method for bottling a liquid in bottles or similar containers;" and U.S. patents: U.S. Pat. No. 5,413,153, entitled "Container filling machine for filling open-top containers, and a filler valve therefor."

Some examples of centering devices for bottle handling devices which may possibly be utilized or adapted for use in at least one possible embodiment may possibly be found in Federal Republic of Germany Application No. DE P 103 14 634, entitled "Spülbares Huborgan" having inventor Herbert Bernhard, and its U.S. equivalent, having Ser. No. 10/813,657, entitled "A beverage bottling plant for filling bottles with a liquid beverage filling material, and an easily cleaned lifting device in a beverage bottling plant" and filed on Mar. 30, 2004; Federal Republic of Germany Application No. DE P 103 08 156, entitled "Huborgan zum Anpressen von Gefässen an Gefässfüllmaschinen" having inventor Herbert Bernhard, and its U.S. equivalent, Ser. No. 10/786,256, entitled "A beverage bottling plant for filling bottles with a liquid beverage filling material, and a container filling lifting device for pressing containers to container filling machines", filed on Feb. 25, 2004; and Federal Republic of Germany Application No. P 103 26 618.6, filed on Jun. 13, 2003, having inventor Volker TILL, and its U.S. equivalent, Ser. No. 10/865,240, filed on Jun. 10, 2004. The above applications are hereby incorporated by reference as if set forth in their entirety herein.

U.S. application Ser. No. 10/939,170, filed on Sep. 10, 2004, having inventor Volker TILL, is hereby incorporated by reference as if set forth in its entirety herein.

Some examples of rotary couplings which may be utilized or adapted for use in at least one possible embodiment may possibly be found in the following U.S. patents: U.S. Pat. No. 5,971,020, entitled "Rotary coupling for an article handler;" U.S. Pat. No. 5,954,912, entitled "Rotary coupling;" U.S. Pat. No. 5,931,194, entitled "Rotary coupling for an article handler;" U.S. Pat. No. 5,81 0,049, entitled "Rotary coupling for an article handler;" U.S. patents: U.S. Pat. No. 5,747,386, entitled "Rotary coupling;" U.S. Pat. No. 4,456,287, entitled "Rotary coupling;" U.S. Pat. No. 4,452,591, entitled "Resilient rotary coupling;" U.S. patents: U.S. Pat. No. 4,449,739, entitled "Rotary coupling;" and U.S. Pat. No. 4,437,846, entitled "Speed limiting rotary coupling."

The embodiments described herein above in the context of the preferred embodiments are not to be taken as limiting the embodiments to all of the provided details thereof, since modifications and variations thereof may be made without departing from the spirit and scope of the embodiments.

What is claimed is:

1. Closure applying machine for closing of container by way of screw caps that are screwed on, comprising a plurality of applying positions that are provided at a circumference of a rotatable machine rotor that rotates about a vertical machine axis, to which positions the containers to be closed are transferred at a container input and the closed containers are removed therefrom at a container output, each closure applying position having a container carrier, a container support, and a screw unit, said screw unit having at its lowermost end a screw head and that can rotate about a vertically directed axis and being configured to be rotated by a drive and wherein the screw head during rotation of the rotor remains at a height-level, wherein the container support comprises at least one depressor, said at least one depressor being configured to contact an upper surface of a neck ring, disposed about the neck of a container, to apply a pressing force on the upper surface of a neck ring to thus effectuate a complete separation of a screw cap from said screw head upon completion of screwing on of the screw cap.

2. Closure applying machine according to claim 1, wherein the means comprise a container support, and said container support comprising a lower contour that is adapted to the structural configuration of the container.

3. Closure applying machine according to claim 2, wherein the container support comprises means that are configured to oppose rotation of the container.

4. Closure applying machine according to claim 3, wherein these means comprise spring elements.

5. Closure applying machine according to claim 3, wherein these means comprise means that are configured to apply an elevated frictional force.

6. Closure applying machine according to claim 3, wherein these means comprise means that oppose a rotation of the container due to their structural configuration and/or a spring bias action.

7. In a beverage bottling plant for filling bottles with a liquid beverage material, a rotatable bottle closing machine being configured and disposed to close tops of filled bottles by screwing on screw caps or closures, said bottle closing machine comprising:

at least one bottle closing device comprising:

a bottle support being configured and disposed to receive and hold filled bottles;

a rotatable screw shaft being configured and disposed to be rotated to screw a screw cap or closure on a filled bottle;

said screw shaft comprises a screw head disposed on an end of said screw shaft;

said screw head being configured and disposed to pick up and hold a screw cap or closure to be screwed onto a filled bottle;

a drive arrangement being configured and disposed to raise said bottle support from a first position, at which said bottle support is disposed a distance away from said screw head, to a second position, at which said bottle support is disposed sufficiently higher than said first position to permit screwing on of a screw cap or closure onto the top of a bottle;

said drive arrangement also being configured and disposed to lower said bottle support from said second position to said first position upon completion of screwing on of a screw cap or closure onto the top of a bottle;

said screw head being configured to remain at a predetermined height during rotation of said rotatable bottle closing machine;

a drive motor being configured and disposed to rotate said screw shaft; and said bottle support being configured to effectuate a complete separation of said screw cap or closure and said screw head upon said screw cap or closure being screwed onto a filled bottle wherein said bottle support comprises at least one depressor structure, said at least one depressor structure being configured to contact an upper surface of a neck ring, disposed about the neck of a bottle, to apply a pressing force on the upper surface of a neck ring to thus effectuate a complete separation of a screw cap or closure from said screw head upon said bottle support being lowered from said first position to said second position.

8. The rotatable bottle closing machine according to claim 7, wherein:

said bottle support comprises a lower contour that is adapted to the structural configuration of a bottle; and said bottle support comprises a structural arrangement to oppose rotation of a bottle being held by said bottle support upon screwing on of said screw cap or closure.

9. The rotatable bottle closing machine according to claim 8, wherein said structural arrangement comprises spring elements.

10. The rotatable bottle closing machine according to claim 8, wherein said structural arrangement comprises an arrangement that is configured to apply an elevated frictional force on a bottle.

11. The rotatable bottle closing machine according to claim 8, wherein said structural arrangement is configured to oppose rotation of a bottle due to structural configuration and/or a spring bias action of said structural arrangement.

12. A beverage bottling plant for filling bottles with a liquid beverage material, said beverage bottling plant comprising:

a bottle cleaning machine being configured and disposed to clean empty bottles;

a feed arrangement to supply empty bottles to said bottle cleaning machine;

a beverage filling machine being configured and disposed to fill empty bottles with liquid beverage filling material;

said beverage filling machine comprising a plurality of beverage filling devices for filling bottles with liquid beverage filling material;

a first conveyer arrangement being configured and disposed to move empty bottles from said bottle cleaning machine into said beverage filling machine;

said first conveyer arrangement comprising a star wheel structure;

a rotatable bottle closing machine being configured and disposed to close tops of filled bottles by screwing on screw caps or closures;

a second conveyer arrangement being configured and disposed to move filled bottles from said rotatable beverage filling machine into said bottle closing machine;

said second conveyer arrangement comprising a star wheel structure; and said bottle closing machine comprising a plurality of closing devices disposed on the periphery of said bottle closing machine;

each of said plurality of closing devices comprising:

a bottle support being configured and disposed to receive and hold filled bottles;

a rotatable screw shaft being configured and disposed to be rotated to screw a screw cap or closure on a filled bottle;

said screw shaft comprises a screw head disposed on an end of said screw shaft;

said screw head being configured and disposed to pick up and hold a screw cap or closure to be screwed onto a filled bottle;

a drive arrangement being configured and disposed to raise said bottle support from a first position, at which said bottle support is disposed a distance away from said screw head, to a second position, at which said bottle support is disposed sufficiently higher than said first position to permit screwing on of a screw cap or closure onto the top of a bottle;

said drive arrangement also being configured and disposed to lower said bottle support from said second position to said first position upon completion of screwing on of a screw cap or closure onto the top of a bottle;

said screw head being configured to remain at a predetermined height during rotation of said rotatable bottle closing machine;

a drive motor being configured and disposed to rotate said screw shaft; and said bottle support being configured to effectuate a complete separation of said screw cap or closure and said screw head upon said screw cap or closure being screwed onto a filled bottle wherein said bottle support comprises at least one depressor structure, said at least one depressor structure being configured to contact an upper surface of a neck ring, disposed about the neck of a bottle, to apply a pressing force on the upper surface of a neck ring to thus effectuate a complete separation of a screw cap or closure from said screw head upon said bottle support being lowered from said first position to said second position.

13. The beverage bottling plant according to claim 12, wherein said bottle support comprises a lower contour that is adapted to the structural configuration of a bottle.

14. The beverage bottling plant according to claim 13, wherein said bottle support comprises a structural arrangement to oppose rotation of a bottle being held by said bottle support upon screwing on of said screw cap or closure.

15. The beverage bottling plant according to claim 14, wherein said structural arrangement comprises spring elements.

16. The beverage bottling plant according to claim 14, wherein said structural arrangement comprises an arrangement that is configured to apply an elevated frictional force on a bottle.

17. The beverage bottling plant according to claim 14, wherein said structural arrangement is configured to oppose rotation of a bottle due to structural configuration and/or a spring bias action of said structural arrangement.

* * * * *